United States Patent [19]

LeBel et al.

[11] Patent Number: 4,842,283

[45] Date of Patent: Jun. 27, 1989

[54] TARGET ASSEMBLY

[76] Inventors: Kenneth LeBel; John P. Melendez, both of 16 La Marcus Ave., Glen Cove, N.Y. 11542

[21] Appl. No.: 46,276

[22] Filed: May 5, 1987

[51] Int. Cl.[4] ..... A63B 69/00; F41J 7/04

[52] U.S. Cl. ..... 273/392; 273/1 B; 273/26 A

[58] Field of Search ..... 273/390, 391, 392, 127 D, 273/1 B, 381, 26 A

[56] References Cited

U.S. PATENT DOCUMENTS

| | | | |
|---|---|---|---|
| 1,348,442 | 8/1920 | Prebble . | |
| 1,547,881 | 7/1925 | Lambert | 273/392 |
| 1,901,171 | 3/1933 | Kauffman | 74/557 |
| 2,710,138 | 6/1955 | Burrows | 74/557 X |
| 3,709,489 | 1/1973 | Holleran et al. . | |
| 3,791,653 | 2/1974 | Yamada | 273/127 D |
| 3,840,228 | 10/1974 | Greaney . | |
| 3,856,298 | 12/1974 | Frantti . | |
| 4,245,843 | 1/1981 | Griggs . | |
| 4,266,780 | 5/1981 | McQuary | 273/392 |
| 4,607,842 | 8/1986 | Daoust | 273/1 B |

FOREIGN PATENT DOCUMENTS

| | | | |
|---|---|---|---|
| 8500164 | 8/1986 | Netherlands | 273/127 D |
| 647417 | 1/1985 | Switzerland | 273/392 |
| 204863 | 10/1923 | United Kingdom | 273/390 |

*Primary Examiner*—Anton O. Oechsle

*Attorney, Agent, or Firm*—Hoffmann & Baron

[57] ABSTRACT

A target assembly adapted for mounting on a support is disclosed. The support will preferably include the crossbar and/or posts of a standard hockey goal. The target assembly includes a contact member having a visually observable surface that is contacted by a properly aimed projectile. The contact member is springily associated with a support arm which is used to mount the target assembly to the support. When the surface of the contact member is contacted by a projectile, such as a hockey puck, the contact member is deflected from a predetermined selected target position, to a substantially transverse position, and thereafter, back to the predetermined selected target position. The present target assembly is particularly useful in developing the accuracy with which a projectile is launched, such as, a hockey puck towards a desired area of a goal.

21 Claims, 2 Drawing Sheets

Fig. 1
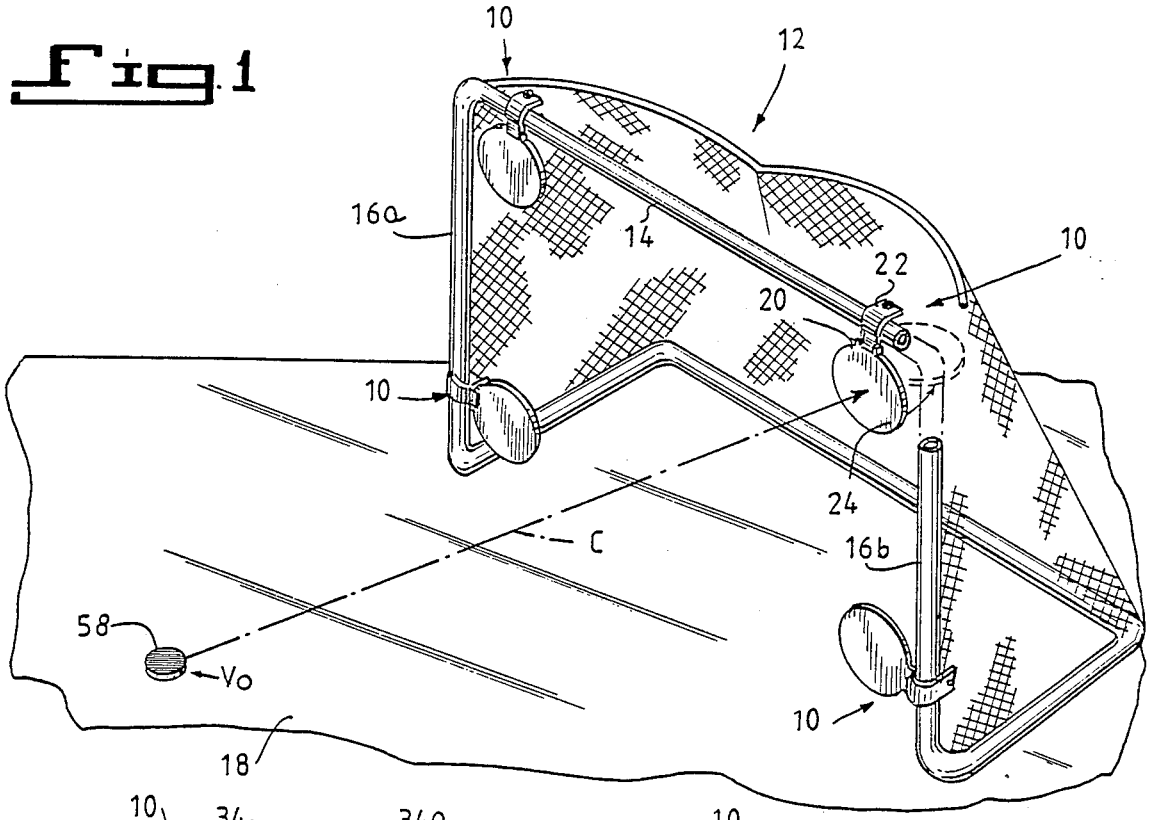
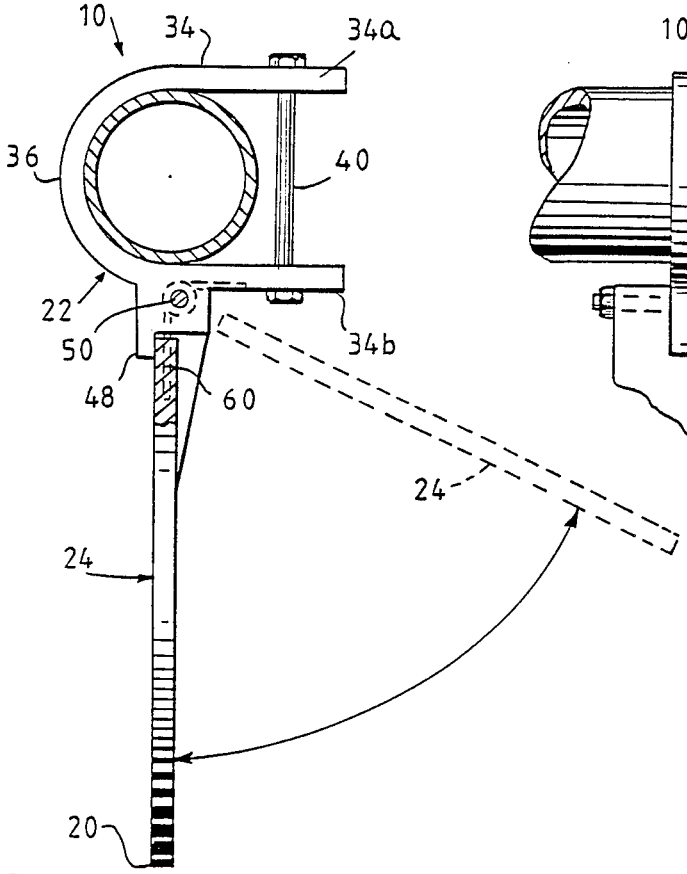
Fig. 2
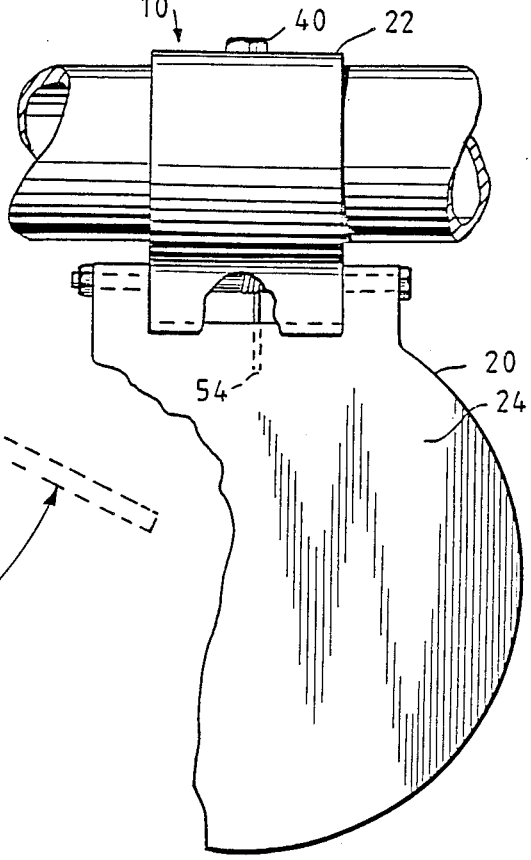
Fig. 3

TARGET ASSEMBLY

BACKGROUND OF THE INVENTION

The present invention relates generally to a target assembly and, more particularly, to a target assembly used for practicing and developing the accuracy with which an object is propelled towards a desired location, such as, a hockey puck towards a goal.

The level of competitiveness and degree of prowess required for effective participation in professional and amateur sports is often evaluated by ones ability to accomplish a fundamental task, that is, score points. Where a pitcher in the game of baseball is concerned however, the opposite would hold true. In particular, the pitcher's fundamental task would be to prevent the scoring of points, which is accomplished by throwing pitches that are incapable of being hit. Each of these fundamental tasks, although quite different, share the same principle for acquiring adeptness, that is, maximized accuracy.

One particular sport in which maximized accuracy is necessary is hockey, whether it be ice hockey, roller hockey or field hockey. In practicing the game of hockey, and, in particular, the shooting aspect thereof, it is often desirable to have a means of simulating the difficulties encountered in an actual game without the necessity of having one or more opposing players present to provide opposition to the player attempting to practice and perfect his game. In the game of hockey, goals are often scored on shots that elude the defensive attempts of a goaltender by penetrating the goal area at the corners and sides of the net. Accurate shooting of the puck at the sides and corners of the net is a desirable skill, but one which is not easy to practice merely with an open goal as a shooting target.

The importance of being able to score goals at the corners and sides of the net has apparently been recognized by the professional hockey community. There has recently been promoted through the mass media a shooting accuracy competition for professional hockey players, in which targets are positioned at various extremities of the goal, at which the shooter aims, no goaltender being present in the nets.

The targets present a front target surface, and break into pieces upon being struck by the puck. Such a target shooting arrangement, in addition to providing a competitive situation as played by the professional hockey players, offers substantial possibilities for practice and training of hockey players on ice, and a pleasant recreational pastime.

However, targets which break into pieces when hit, although satisfying and pleasing to the participants, are not acceptable for regular hockey practice and training sessions, because of expense and because of the resulting debris which litters the ice surface.

Thus, it would be desirable to have a device which aids in the development of shooting accuracy and one which would be practical and conducive to actual practice sessions. In this regard, U.S. Pat. No. 4,245,843 to Griggs discloses a hockey target comprising a target element mounted in a peripheral framework, from which the element is removed on being struck by a properly aimed hockey puck, ball etc. A saddle is provided for mounting the framework at suitable locations in the goalmouth of a hockey net. The target element is of flexible compressible impact resistant material, e.g., rubbery foam polyurethane.

U.S. Pat. No. 3,856,298 to Frantti discloses a hockey practice apparatus including a barricade suitable for attachment to the forward portion of the hockey goal, the barricade having one or more openings through which a puck can pass.

U.S. Pat. No. 3,840,228 to Greaney discloses a hockey goal combined with a V-shape goaltender therefor. The device is affixed in a forwardly disposed V-shape in front of a hockey goal whereby pucks striking the device are diverted to either side thereof. Additionally, the device has an aperture therethrough simulating the opening between the legs of a player and a pocket therein for receiving and holding a puck simulating the catching of a puck by a player.

U.S. Pat. No. 3,709,489 to Holleran et al. discloses a hockey skill-testing, practice and game apparatus comprising a self-supporting, multi-sectioned upstanding wall structure defining three substantially-rectilinear compartments, two of which include a vertically-disposed wall having a plurality of puck receiving apertures therethrough.

U.S. Pat. No. 1,348,442 to Prebble discloses a game apparatus comprising a supporting frame having a series of horizontal bars on which an arrangement of disks or targets are pivoted by hinges at suitable distances apart. Balls may be thrown at the apparatus in an attempt to strike the targets.

Accordingly, it is an object of the present invention to provide a target assembly which can be used for practicing and developing the accuracy with which an object is propelled towards a desired location.

It is another object of the present invention to provide such a target assembly for repetitive, practical and expedient use in the practice of athletics.

It is a further object of the present invention to provide such a target assembly for improving the accuracy with which a hockey puck is shot.

It is still another object of the present invention to provide such a target assembly for improving the accuracy with which a baseball is pitched.

SUMMARY OF THE INVENTION

In accomplishing the foregoing objects and advantages the present invention relates to a target assembly adapted to be mounted to a support member such as the horizontal crossbar or vertical posts associated with a hockey goal. The target assembly comprises:

a support arm;

a contact member having a visibly observable surface;

means for interconnecting said contact member and said support arm so that said contact member is resiliently deflectable with respect thereto;

means for removably affixing said support arm to the support; and the support arm and contact member being positioned when said support arm is affixed to said support so that the visually observable surface is in a predetermined selected target position for engagement and deflection by a projectile launched with adequate force in the direction of said visually observable surface and along a trajectory defined by an initial launching position of said projectile and at least a portion of said surface, so that when said projectile contacts said surface the accompanying force of said projectile causes said contact member to be displaced from the prdetermined selected target position to a substantially transverse position, and thereafter, back to the predetermined selected target position.

The contact member and support arm are interconnected by, among other things, a bolt and securing members associated with the contact member. In addition to cooperating in the interconnection of the contact member and support arm, the securing members are disproportionately contoured, such that the upper portion is of increased thickness with respect to the lower portion, thereby imparting reinforcement and strength to the contact member so that it can better understand the force associated with the moving projectile.

A boss associated with the support arm is also cooperatively employed in the interconnection of the contact member and support arm. The boss includes, among other things, a downwardly protruding shoulder which prevents the contact member from moving beyond the predetermined selected target position as it returns from the substantially transverse position.

BRIEF DESCRIPTION OF THE DRAWINGS

FIG. 1 is a perspective view of a hockey goal positioned on a surface, illustrating four targets disposed about the corners thereof;

FIG. 2 is a side view of the target assembly of the present invention mounted on a support member shown in cross-section;

FIG. 3 is a front view of the target assembly illustrated in FIG. 2;

DESCRIPTION OF THE PREFERRED EMBODIMENTS

Figure 4:
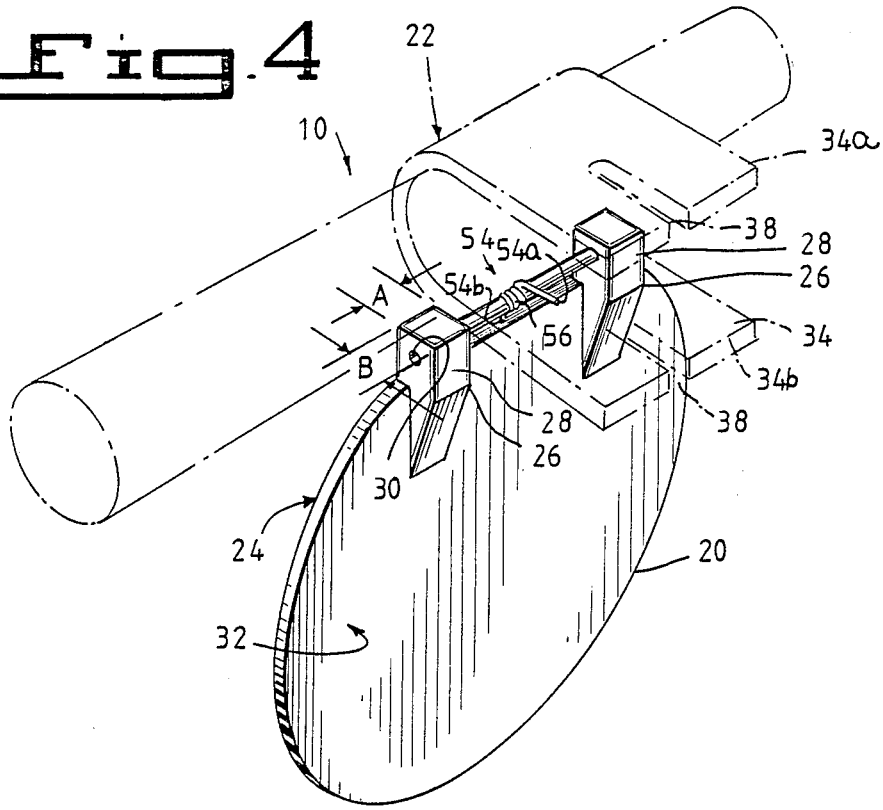
FIG. 4 is a transparent perspective view of the target assembly of the present invention illustrating the interrelationship of the components thereof.

The present invention relates to a target assembly adapted to be mounted on a support which, in one embodiment, can be the posts and/or crossbar of a typical hockey goal. Thus, by referring to the drawings, where like components are represented by like reference numerals, and, in particular, FIG. 1, illustrated is the target assembly 10 of the present invention disposed about the four corners of hockey goal 12. While FIG. 1 illustrates four (4) of the present target assemblies, this is intended to be merely illustrative and, it is to be understood that additional or fewer target assemblies can be employed. Target assembly 10 is mounted on a support which, as illustrated, includes crossbar 14 and posts 16*a*, 16*b*. A typical goal 12 employed in the game of hockey includes posts 16*a*, 16*b* positioned six (6) feet apart from each other on the transverse plane. Crossbar 14 is positioned four (4) feet above surface 18. While target assembly 10 is illustrated as being positioned about the corners of goal 12, it is to be understood that target assembly 10 is capable of being interchangeably and selectively positioned on a support since each individual target assembly can be vertically displaced along posts 16*a*, 16*b* or transversely displaced along crossbar 14 and affixed in any position along those respective planes in a manner which will be described hereinafter in further detail.

Referring generally to the drawings, it can be seen that target assembly 10 comprises two major components, contact member 20 and support arm 22. In a preferred embodiment, contact member 20 is essentially a disc having a front surface 24. While contact member 20 is illustrated as a disc, it is to be understood that it can assume a variety of shapes, provided that a contact member assuming an alternate shape includes a front surface that substantially corresponds to front surface 24. Thus, in a preferred embodiment, the diameter of front surface 24 is about 7 to about 7.5 inches. If the diameter were substantially larger, the difficulty one would encounter in contacting front surface 24 with an aimed projectile, such as a hockey puck, would be minimal. Notwithstanding the foregoing, modification of front surface 24 of contact member 20 is within the scope of the present invention.

In a preferred embodiment, front surface 24 can be brightly colored to accentuate its visibility to the shooter, as well as to accentuate the observability of the deflection thereof when contacted by a projectile in a manner which will hereinafter be explained.

Contact member 20 is fabricated from a material which is at least slightly flexible so that it will maintain its structural integrity when subjected to the forces associated with a moving projectile. And, for the same reason, contact member 20 is fabricated from a material which is capable of withstanding the temperature gradient typically experienced at the proximity of surface 18, especially when the present device is used outdoors in freezing temperatures or indoors on ice rinks where temperatures fluctuate from ambient temperature to temperatures at or below freezing. Additionally, contact member 20 is preferably fabricated from a material which produces an audible sound when contacted by a projectile. Thus, bearing in mind the foregoing considerations, contact member 20 is fabricated from a suitable gauge of steel or other suitable material. Certain metals would be unsuited for use herein, since their excessive weight or inflexibility would not provide a contact member that is consonant with the foregoing considerations. In a most preferred embodiment, contact member 20 is fabricated from a material available under the name, Hytrel No. 5527, from E. I. duPont de Nemours & Company, Wilmington, Del.

Contact member 20 can also have an audible device associated with it, such as a bell or alarm so that when front surface 24 is contacted by a projectile, the audible device is either mechanically or electrically actuated thereby producing an audible sound which verifies that contact has been made. Although not shown, it is to be understood that the audible device can be disposed either partially or completely within the contact member. Alternatively, the audible device can be mounted on the contact member in any conventional manner.

Referring to FIG. 4, illustrated are securing members 26 associated with contact member 20. Securing members 26 can be integrally associated with contact member 20 or can be attached thereto in any conventional manner. The upper portion 28 of securing member 26 has a thickness B and a width A. In a preferred embodiment, thickness B is about $\frac{3}{4}$ inches and width A is about 2 3/32 inches. Upper portion 28 includes an aperture 30 which functions as a receiving means for securing contact member 20 to support arm 22 in the manner to be hereinafter described.

In a preferred embodiment, the thickness of securing member 26 is progressively reduced with respect to thickness B and eventually approaches zero as securing member 26 extends down and rear surface 32 of contact member 20. Such an arrangement serves to preserve the integrity of contact member 20 after it is subjected to repetitive contact by a projectile, since the increased thickness at the top of securing member 26 serves to reinforce contact member 20.

Referring once again generally to the drawings, illustrated is the other major component of target assembly 10, namely, support arm 22 which includes substantially U-shaped member 34. Substantially U-shaped member 34 includes two arms 34*a*, 34*b* which are arranged in parallel relation. Arms 34*a*, 34*b* are associated with one another by way of semi-annular member 36, thereby forming a unitary, substantially U-shaped member 34. Arms 34*a*, 34*b* each include a slot 38 which extends from the end of each respective arm and continues substantially along the length of each arm. Slot 38 is adapted to receive bolt 40, which will provide a means for further securing substantially U-shaped member 34 to a support in a manner to be hereinafter described.

Figure 5:
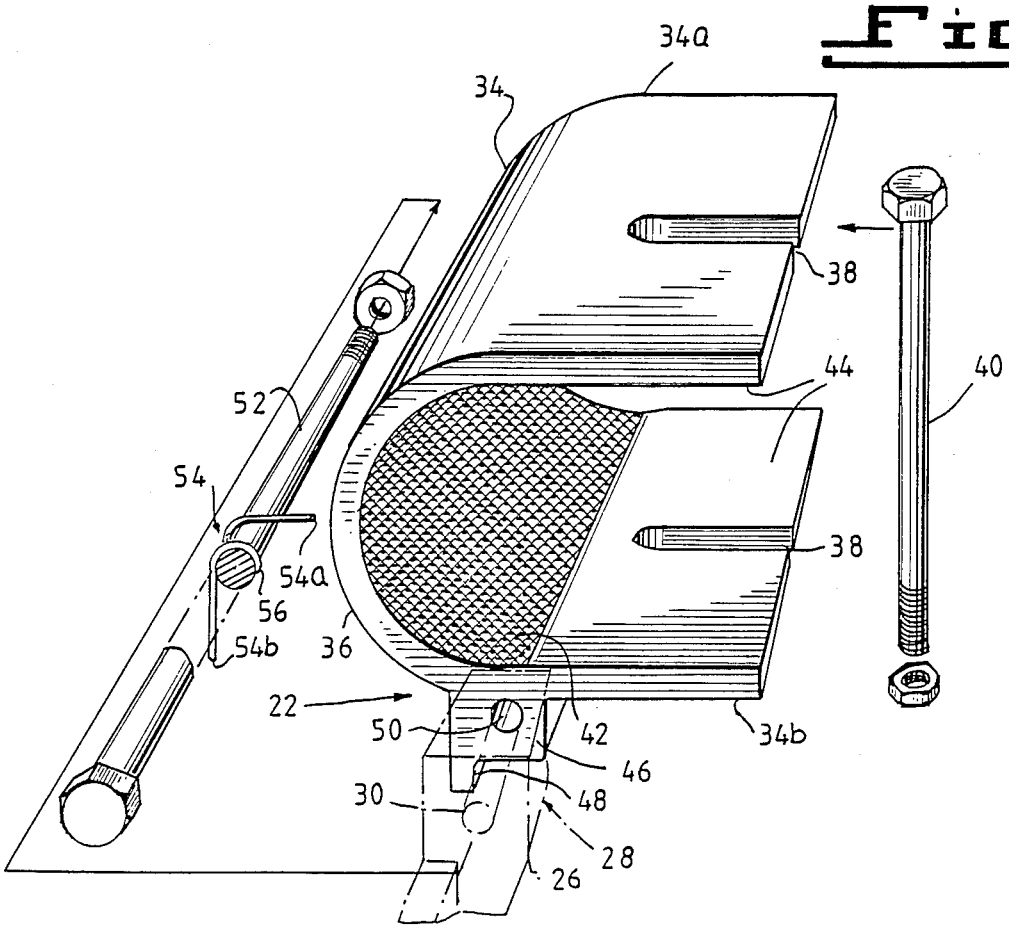
FIG. 5 is a perspective view of the support arm of the target assembly of the present invention.

Semi-annular member 36 includes an inner concave surface 42, illustrated best in FIG. 5. Inner concave surface 42 is out of alignment with planar surface 44 of arms 34*a* and 34*b*. Such an arrangement forms a recess having an inner perimeter, slightly larger than and which substantially conforms to the contour of the outer perimeter of a support, so that the support can be better accommodated by the substantially U-shaped member 34 of support arm 22.

In a preferred embodiment, inner concave surface 42 is coarsely textured to assist in preventing the lateral and rotational displacement of support arm 22 along the surface of a support.

Substantially U-shaped member 34 carries a boss 46, which is associated with a portion of arm 34*b* and a portion of semi-annular member 36. Boss 46 includes a shoulder 48 and an aperture 50 which extends through boss 46.

Support arm 22 can be fabricated from any suitable material, preferably one which is both durable and substantially rigid. Most preferably, support arm 22 is fabricated from a material available under the name Zytel, from E. I. duPont de Nemours & Company, Wilmington, Del.

When contact member 20 and support arm 22 are assembled, they become pivotably associated with one another. To complete the assembly of contact member 20 and support arm 22, aperture 50 of boss 46 is correspondingly aligned with aperture 30 of securing member 26 to slidably receive bolt 52. As apertures 50, 30 receive bolt 52 and the latter becomes secured by tightening the nut associated therewith, contact member 20 is permitted to oscillate beyond a predetermined selected target position (i.e. the vertical plane), when force is applied thereto, as support arm 22 is maintained in a stationary position.

In addition to contact member 20 and support arm 22 being pivotably associated, they are, in a preferred embodiment, springily associated by way of spring 54. Spring 54 includes two legs 54*a*, 54*b* and a coiled vertex 56. Coiled vertex 56 includes a hollow center member which is adapted to receive bolt 52. Legs 54*a*, 54*b* can either be embedded within contact member 20 and arm 34*b* or, alternatively, legs 54*a*, 54*b* can be secured in any conventional manner, to the rear surface 32 of contact member 20 and the bottom surface of arm 34*b*.

In a preferred embodiment, legs 54*a*, 54*b* of spring 54 form a right angle at coiled vertex 56. Most preferably, legs 54*a*, 54*b* are each ¾ inches in length and coiled vertex 56 includes two (2) coils. While spring 54 may be fabricated from any material suitable to impart a spring action into contact member 20 after being contacted by a projectile, stainless steel is the most preferred material to be employed.

Target assembly 10 is secured to a support, such as crossbar 14 or posts 16*a*, 16*b*, by positioning substantially U-shaped member 34 in a manner which permits the support to become disposed between the space created by arms 34*a* and 34*b*. Substantially U-shaped member 34 is then urged forward until inner concave surface 42 abuts the surface of the support, so that the support is received and accommodated by the recess of inner concave surface 42. The securing of support arm 22 to the support is completed by inserting bolt 40 within slot 38 until the surface of bolt 40 comes in contact with the surface of the support opposite that surface abutting inner concave surface 42. Bolt 40 is then tightened to secure substantially U-shaped member 34 onto the support, as can best be illustrated in FIG. 5 when viewed in conjunction with FIG. 2.

Since arms 34*a*, 34*b* are slightly resilient, when they are positioned over the support, and as bolt 40 becomes tightened, a torque action is created which enhances the connection between support arm 22 and the support. Such an arrangement will serve to facilitate and expedite attachment and removal of target assembly 10 to a support. Moreover, such an arrangement will insure that the support arm will maintain its stationary position on the support as the contact member is caused to move.

Referring now particularly to FIG. 1, disposed on support members 14, 16*a* and 16*b* is the target assembly 10 of the present invention. As illustrated, when target assembly 10 is not in use, i.e., is stationary, contact member 20 remains at rest in a predetermined selected target position, i.e., along the vertical plane. When a projectile 58, such as a hockey puck, is launched with adequate force in the direction of contact member 20 and along trajectory C, defined by the initial launching position (Vo) of projectile 58 and at least a portion of front surface 24, the force associated with moving projectile 58 causes contact between projectile 58 and front surface 24. Such contact causes contact member 20 to be deflected from the predetermined selected target position, and thereafter, resiliently returned to the predetermined selected target position. Contact member 20 is permitted to be rapidly displaced back to the predetermined selected target position due to the nature of spring 54. Shoulder 48 comes in contact with a portion 60 of front surface 24 and prevents contact member 20 from oscillating beyond the predetermined selected target position.

Although not illustrated, it is within the scope of the present invention to employ target assembly 10 for developing accuracy in sports other than hockey. For instance, one alternative use would be in developing the accuracy with which a baseball is pitched. Thus, the present target assembly can be mounted on support members in a manner which outline the outermost perimeter of a "strike zone" so that a pitcher can develop a level of adeptness in hurling the ball towards these areas.

Another alternative use of target assembly 10 would be in developing shooting accuracy in the sport of Lacrosse.

While preferred embodiments and several variations of the present invention are described in detail herein, it should be apparent that the disclosure and teachings of the present invention will suggest many alternative designs to those skilled in the art.

What is claimed is:

1. A target assembly adapted to be mounted on a support member which comprises:

a support arm;

a contact target member having a visibly observable surface;

means for pivotally interconnecting said contact target member and said support arm so that said contact target member is permitted to undergo angular displacement from a preselected target position;

biasing means for biasing said contact target member to return to said preselected target position;

means for preventing said contact target member from undergoing angular displacement in a preselected direction beyond said preselected target position;

means for removably affixing said support arm to the support member and for adjustment of the position of said target assembly therealong; and said support arm and said contact member being positionable so that, when said support arm is affixed to said support member, said visually observable surface of said contact target member is in the predetermined selected target position for engagement and deflection by a moving projectile, so that when the projectile contacts said surface, the accompanying force of the projectile causes said contact target member to be angularly displaced from the preselected target position, and after angular displacement beyond said preselected target position, resiliently returning thereto.

2. The target assembly of claim 1 wherein said biasing means comprises a spring associated with said contact member and said support arm, said spring having two legs and a coiled vertex.

3. The target assembly of claim 2 wherein said two legs are each ¾ inches in length and said coiled vertex includes two coils.

4. The target assembly of claim 2 wherein said spring is fabricated from stainless steel.

5. The target assembly of claim 1 wherein said contact member is fabricated from a flexible material so that said contact member will maintain its structural integrity when subjected to the force associated with the moving projectile.

6. The target assembly of claim 1 wherein said contact member is fabricated from a material capable of maintaining its structural integrity at temperatures at or below freezing.

7. The target assembly of claim 1 wherein said contact member is fabricated from a material which produces an audible sound when contacted by said projectile.

8. The target assembly of claim 1 wherein said means for preventing said contact target member from undergoing angular displacement in said preselected direction beyond said preselected target position comprises a shoulder disposed on said support arm.

9. The target assembly of claim 1 wherein the diameter of said visibly observable surface is about 7 to about 7.5 inches.

10. The target assembly of claim 1 wherein said visibly observable surface is brightly colored to accentuate the visibility thereof, and observability of the deflection thereof when contacted by said projectile, to a person launching said projectile.

11. The target assembly of claim 1 further comprising securing members associated with said contact member for securing said contact member to said support arm.

12. The target assembly of claim 11 wherein said securing members are integrally associated with said contact member.

13. The target assembly of claim 11 wherein said securing member has a thickness of about ¾ inches and a width of about 2 3/32 inches.

14. A target assembly for mounting on a support member, which comprises:

a support arm;

a contact member having a visibly observable surface;

means for interconnecting said contact member and said support arm so that said contact member is resiliently deflectable with respect thereto;

means for removably affixing said support arm to the support; and said support arm and said contact member being positioned, when said support arm is affixed to said support, so that the visually observable surface is in a predetermined selected target position for engagement and deflection by a projectile launched with adequate force in the direction of said visually observable surface and along a trajectory defined by an initial launching position of said projectile and at least a portion of said surface, so that when said projectile contacts said surface the accompanying force of said projectile causes said contact member to be deflected from the predetermined selected target position, and thereafter, resiliently returned to the predetermined selected target position, said target assembly further comprising securing members associated with said contact member for securing said contact member to said support arm, said securing means having a thickness of about ¾ inch and a width of about 2 3/32 inches, said thickness of said securing member being progressively reduced as a portion of said securing member extends down along said contact member.

15. The target assembly of claim 1 wherein said support arm comprises a substantially U-shaped member including two arms arranged in parallel relation, said arms being associated with one another by a semi-annular member.

16. The target assembly of claim 15 wherein said semi-annular member includes an inner concave surface that is out of alignment with the planar surface of said two arms thereby forming a recess for receiving and accommodating said support member.

17. The target assembly of claim 16 wherein said inner concave surface is coarsely textured to assist in preventing the lateral displacement of said support arm along said support member.

18. The target assembly of claim 15 wherein said arms each include a slot extending from an end of each of said arms and continuing substantially along the length of each of said arms, said slot being adapted to receive a bolt for further securing said support arm to said support member.

19. A target assembly comprising:

a support arm;

a contact member having a visibly observable surface;

means for interconnecting said contact member and said support arm so that said contact member is resiliently deflectable with respect thereto;

means for removably affixing said support arm to the support; and said support arm and said contact member being positioned, when said support arm is affixed to said support, so that the visually observable surface is in a predetermined selected target position for engagement and deflection by a projectile launched with adequate force in the direction of said visually observable surface and along a trajectory defined by an initial launching position of said projectile and at least a portion of said surface, so that when said projectile contacts said surface the accompanying force of said projectile causes said contact member to be deflected from the predetermined selected target position, and thereafter, resiliently returned to the predetermined selected target position, said support arm comprising a substantially U-shaped member including two arms arranged in parallel relation, said arms being associated with one another by a semi-annular member, said substantially U-shaped member further including a boss associated with a portion of one of said arms and a portion of said semi-annular member, said boss having a shoulder and an aperture extending through said boss.

20. A sport target assembly for removable mounting onto a support member of sport apparatus, said target assembly comprising:

a support arm;

a contact target member having a visibly observable surface;

means for pivotally interconnecting said target member and said support arm so that said target member is permitted to undergo angular displacement from a preselected target position;

biasing means for biasing said target member to return to said preselected target position;

swing-delimiting means for preventing said target member from undergoing angular displacement in a preselected direction beyond said preselected target position; and means for removably mounting and adjusting said support arm to the support member of the sporting apparatus, whereby said target member upon being struck by the moving projectile is prevented from undergoing angular displacement in said preselected direction beyond said preselected target position.

21. The sport target assembly of claim 20 wherein said support arm comprises a substantially U-shaped member.

* * * * *